US008360796B2

(12) United States Patent
Daubigney

(10) Patent No.: US 8,360,796 B2
(45) Date of Patent: Jan. 29, 2013

(54) DEVICE FOR LATCHING A CONNECTOR DEVICE AND ASSOCIATED TOOL

(75) Inventor: Patrick Daubigney, Authume (FR)

(73) Assignee: CoActive Technologies, LLC, Newton, MA (US)

( * ) Notice: Subject to any disclaimer, the term of this patent is extended or adjusted under 35 U.S.C. 154(b) by 313 days.

(21) Appl. No.: 12/602,251

(22) PCT Filed: May 14, 2008

(86) PCT No.: PCT/EP2008/055900

§ 371 (c)(1),
(2), (4) Date: Aug. 9, 2010

(87) PCT Pub. No.: WO2008/145516

PCT Pub. Date: Dec. 4, 2008

(65) Prior Publication Data

US 2010/0323548 A1 Dec. 23, 2010

(30) Foreign Application Priority Data

May 30, 2007 (FR) ..... 07 55330

(51) Int. Cl.
*H01R 4/50* (2006.01)

(52) U.S. Cl. ..... 439/345; 439/378

(58) Field of Classification Search ..... 439/345, 439/359, 378, 562, 564, 573, 953, 357
See application file for complete search history.

(56) References Cited

U.S. PATENT DOCUMENTS

| | | | | |
|---|---|---|---|---|
| 3,030,602 | A * | 4/1962 | Jackson et al. | 439/363 |
| 3,193,309 | A | 7/1965 | Morris | |
| 3,493,917 | A | 2/1970 | Glowacz | |
| 4,895,535 | A * | 1/1990 | Emadi et al. | 439/681 |
| 4,934,950 | A * | 6/1990 | Green et al. | 439/681 |
| 5,066,246 | A * | 11/1991 | Jensik | 439/562 |
| 5,306,175 | A * | 4/1994 | Swanstrom | 439/362 |
| 5,473,510 | A * | 12/1995 | Dozier, II | 361/719 |
| 5,823,812 | A * | 10/1998 | Bhargava et al. | 439/345 |
| 5,833,472 | A * | 11/1998 | Bright | 439/70 |
| 6,059,600 | A * | 5/2000 | Vanbesien | 439/378 |
| 6,773,286 | B1 * | 8/2004 | Wu | 439/247 |
| 7,621,754 | B2 * | 11/2009 | Costello | 439/65 |

FOREIGN PATENT DOCUMENTS

| | | |
|---|---|---|
| FR | 2661564 A | 10/1991 |
| FR | 2527015 A | 11/1993 |

* cited by examiner

*Primary Examiner* — Thanh Tam Le
(74) *Attorney, Agent, or Firm* — Fox Rothschild LLP

(57) ABSTRACT

A device for latching a first connector to a complementary second connector. The device including a female element that is fixed to the first connector and delimits a housing open axially rearward, at least one elastically deformable retaining finger that projects radially inside the housing of the female element, a male element that is carried by the second connector and includes a latching front section furnished with a retaining notch, the latching section being adapted to be inserted axially from the rear toward the front into the housing of the female element as far as a front latching position in which the retaining finger is received in the retaining notch to immobilize the first connector axially on the second connector.

19 Claims, 13 Drawing Sheets

DEVICE FOR LATCHING A CONNECTOR DEVICE AND ASSOCIATED TOOL

RELATED APPLICATION AND CLAIM OF PRIORITY

This application claims the priority benefit of P.C.T. Application no. PCT/EP2008/055900 filed May 14, 2008, which is hereby incorporated by reference in its entirety; which claims priority to France Patent Application No. 0755330 filed May 30, 2007.

BACKGROUND

The present disclosure concerns a device for latching a connector system. More specifically, the present disclosure invention concerns a tool for latching and unlatching the latching device.

Generally speaking, an electronic device, such as a computer, in order to exchange data with at least one peripheral device, is connected to the peripheral device by means of a connector system. The connector system includes a first connector with a female portion and a second connector with a complementary male portion which is adapted to be connected to the female portion.

Sometimes the connector system includes a device for mechanically latching the first connector to the second connector that is independent of the male and female electrical contact elements to prevent accidental disconnection thereof. One known latching device of this type latches the first connector to the second connector by means of a nut and bolt type assembly. This type of latching device is frequently provided in D-Sub type connector systems.

This latching device includes two nuts carried by the first connector and two associated complementary screws mounted to rotate freely on the second connector such that when each bolt is screwed into the associated nut the first connector is latched to the second connector. Such a latching device is effective. Nevertheless, the screwing and unscrewing operations required to latch and unlatch the connector system take a relatively long time, especially as this time has to be multiplied by the number of connector systems, which can be high on some equipment.

U.S. Pat. No. 6,929,501 describes a latching system that reduces the time to latch and unlatch a first connector and a second connector.

According to that document, the first connector includes a first connection portion that extends rearward and the second connector includes a second connection portion that is complementary to the first and extends forward. The first connector includes two opposed housings that are arranged on either side of the first connection portion in a general plane of symmetry and that are open rearward. Each housing includes an elastically deformable latching plate that extends rearward and a rear end of which is provided with a notch. The second connector includes two latches arranged on either side of the second connection portion. The latches extend forward and each includes a catch at its free end.

When the first portion of the first connector is connected to the complementary second portion of the second connector, the catch of each latch is received in the notch of the associated latching plate of the first connector to oppose withdrawal of the second connector and thus to latch the first connector to the second connector. Each latching plate of the first connector cooperates with an operating button which by a lever effect when it is pressed by a user causes the associated latching plate to move to an unlatching position in which the notch of the latching plate releases the catch of the associated latch lug to unlatch the first connector and the second connector.

A drawback of this latching device is the accessibility of the unlatching buttons, which are on two opposite flanks of the first connector. These buttons are inaccessible or virtually inaccessible to the hand of the user if the connector is recessed or if it is disposed side by side with other connectors. Moreover, this latching device is dependent on the connector system that it equips. For example, it is not adapted to be mounted on an existing connector system as a substitute for a latching device of the nut and bolt type like that described above.

In the same field, the France Patent No. 2,661,564 describes a device for latching and unlatching a first connector and a second connector. According to that document, the first connector includes a first connection portion that extends rearward and the second connector includes a second connection portion that is complementary to the first portion and extends forward. The first connector includes a first housing and an opposed second housing that are arranged on either side of the first connection portion in a general plane of symmetry and each of which extends axially and is open rearwardly. The second connector includes a first pin and a second pin each of which delimits a retaining groove.

When the first connector is connected to the associated second connector, the first pin and the second pin are in the first housing and the second housing of the first connector, respectively. The device includes a pusher member or a puller member that delimits a first opening and a second opening and is mounted to slide radially in the first connector from an unlatching position to a latching position in which each opening of the pusher member cooperates with the associated groove of the first pin and the second pin so as to latch the second connector axially to the first connector. The pusher member includes a portion forming an operating button that projects on one side of the first connector and which, when pressed by a user, causes the pusher member to slide transversely from its latching position to its unlatching position, in which the pusher member releases the pins to unlatch the first connector and the second connector. This latching and unlatching device has the same drawbacks as the device described above.

SUMMARY

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

It must be noted that as used herein and in the appended claims, the singular forms "a," "an," and "the" include plural reference unless the context clearly dictates otherwise. Thus, for example, reference to a "coil" is a reference to one or more coils and equivalents thereof known to those skilled in the art, and so forth. Unless defined otherwise, all technical and scientific terms used herein have the same meanings as commonly understood by one of ordinary skill in the art. As used herein, the term "comprising" means "including, but not limited to."

In a general respect, the present disclosure concerns a device for latching a first connector to a complementary second connector, the device including a female element that is fixed to the first connector and delimits a housing open axially rearward, at least one elastically deformable retaining finger that projects radially inside the housing of the female element, a male element that is carried by the second connector and includes a latching front section furnished with a retaining notch, the latching section being adapted to be inserted axially from the rear toward the front into the housing of the female element as far as a front latching position in which the retaining finger is received in the retaining notch to immobilize the first connector axially on the second connector.

The present disclosure attempts in particular to remedy various drawbacks of the existing art by proposing a device for latching a first connector and a second connector of the type described above characterized in that it includes an unlatching member that is carried by the male element and is adapted to slide axially from the rear toward the front between the latching section and the finger, between a rear rest position and a front unlatching position in which the unlatching member retracts the retaining finger out of the notch.

According to other features of the disclosure, the retaining finger extends axially and obliquely from the rear toward the front toward the interior of the housing such that the free front end of the finger faces a radial rear face of the notch of the male element when the male element occupies its front latching position, the male element includes a first radial front face forming a shoulder from which a head extends rearward, the head of the male element being situated outside the housing when the male element occupies its latching position, and the unlocking member includes a radially projecting rear section a radial rear face of which bears axially against the first radial front face of the male element when the unlatching member occupies its rear rest position, the second connector includes a radial flange that delimits a through-hole in which the male element is mounted to slide axially from the rear toward the front and the device includes first return spring means adapted to urge the male element in the rearward direction, and the male element has a second radial front face that is offset angularly relative to its first radial front face and the first return spring means include at least one elastically deformable first return prong that is disposed axially between a rear face of the flange of the second connector and the second radial front face of the male element, the first return prong being V-shaped and bent radially outward.

The device further includes second spring return means for urging the unlatching member toward its rear rest position, wherein the second spring return means include at least one elastically deformable second return prong that is disposed axially between a radial front face of the rear section of the unlatching member and the rear face of the flange of the second connector, the first return prong and the second return prong are parts of a one-piece sheet metal multifunction spring bent and cut to shape, the multifunction spring is fixed to the male element, the multifunction spring includes at least one prong for attaching the male element to the associated second connector such that the assembly formed by the male element, the multifunction spring and the unlatching member is captive on the second connector, and the rear actuating section of the unlatching member includes at least one portion projecting radially relative to the head of the male element such that the projecting portion of the actuation section constitutes a pusher member for driving the unlatching member toward its front unlatching position.

The device further includes an actuation knurled wheel that is mounted to rotate freely on the rear head of the male element and includes a threaded portion adapted to cooperate with a complementary threaded portion of the unlatching member such that the unlatching member can be driven into its front unlatching position by rotating the knurled wheel, wherein the assembly formed by the male element, the multifunction spring and the unlatching member has an axial plane of symmetry, the latching device includes an indicator device furnished with a visual indicator for indicating visually that the male element is occupying its front latching position in the female element.

The device may include an indicator device, the indicator device including a pin that extends axially in the housing of the female element, an axial open well that is delimited by the male element, and a visual indicator, which extends axially from the rear toward the front in the well, from a visualization rear head to a drive front head, the indicator being mounted to slide axially in the well such that the indicator occupies a front position retracted or concealed in the well to which the indicator is returned elastically by return spring means when the male element occupies its rear rest position, and the indicator occupies a rear indicating position in which the front head of the indicator cooperates with the pin that opposes the spring return of the indicator when the male element occupies its front latching position in the female element such that the rear indicator head of the indicator can be seen by a user.

The device further includes an additional male element that is fixed to an intermediate third connector that is disposed between the first connector and the second connector, the additional male element including an additional rear head delimiting an additional housing open axially rearward in which there is at least one additional retaining finger, and wherein the latching front section of the male element is adapted to be inserted axially in the direction from the rear toward the front as far as a latching position in which the additional retaining finger is received in the retaining notch of the male element to immobilize the second connector axially on the intermediate third connector, an additional latching front section that is furnished with an additional notch and is adapted to be inserted axially in the direction from the rear toward the front into the housing of the female element as far as a latching position in which the retaining finger of the female element is received in the additional retaining notch to immobilize the intermediate third connector axially on the first connector, and an additional unlatching member that is carried by the additional male element and is adapted to slide axially in the direction from the rear toward the front between the additional front latching section and the finger of the female element between a rear rest position and a front unlatching position in which the additional unlatching member retracts the retaining finger out of the additional notch.

The present disclosure also relates to a latching tool intended to drive the male element axially, characterized in that the latching tool includes a tubular portion that is adapted to be engaged axially around the head of the male element to center the head relative to the latching tool, and at least one axial arm a free end of which is adapted to bear axially on a radial rear branch of the first return prong bent in a V-shape to drive the latching member into its front unlatching position.

The present disclosure also relates to an unlatching tool intended to cooperate with the unlatching member of the device, characterized in that the free end of the unlatching tool includes a radial edge adapted to cooperate by axial bearing engagement on the pusher member of the unlatching member in order to drive the unlatching member into its position before unlocking.

The present disclosure also relates to a multifunction tool, characterized in that it has the general shape of a rod a first end of which includes a latching tool and an opposite second end of which includes an unlatching tool according to the invention.

BRIEF DESCRIPTION OF THE DRAWINGS

Other features and advantages of the invention will become apparent on reading the following detailed description, to understand which refer to the appended figures, in which.

DETAILED DESCRIPTION

For the purposes of describing the invention, to clarify the claims, and by way of nonlimiting example, the vertical, longitudinal and transverse orientations are as shown by the system of axes V, L, T indicated in the figures. Additionally, the rearward to forward orientation corresponds to a longitudinal direction from left to right in FIG. 2. In the following description, identical, similar or analogous elements are designated by the same reference numbers.

Figure 1:
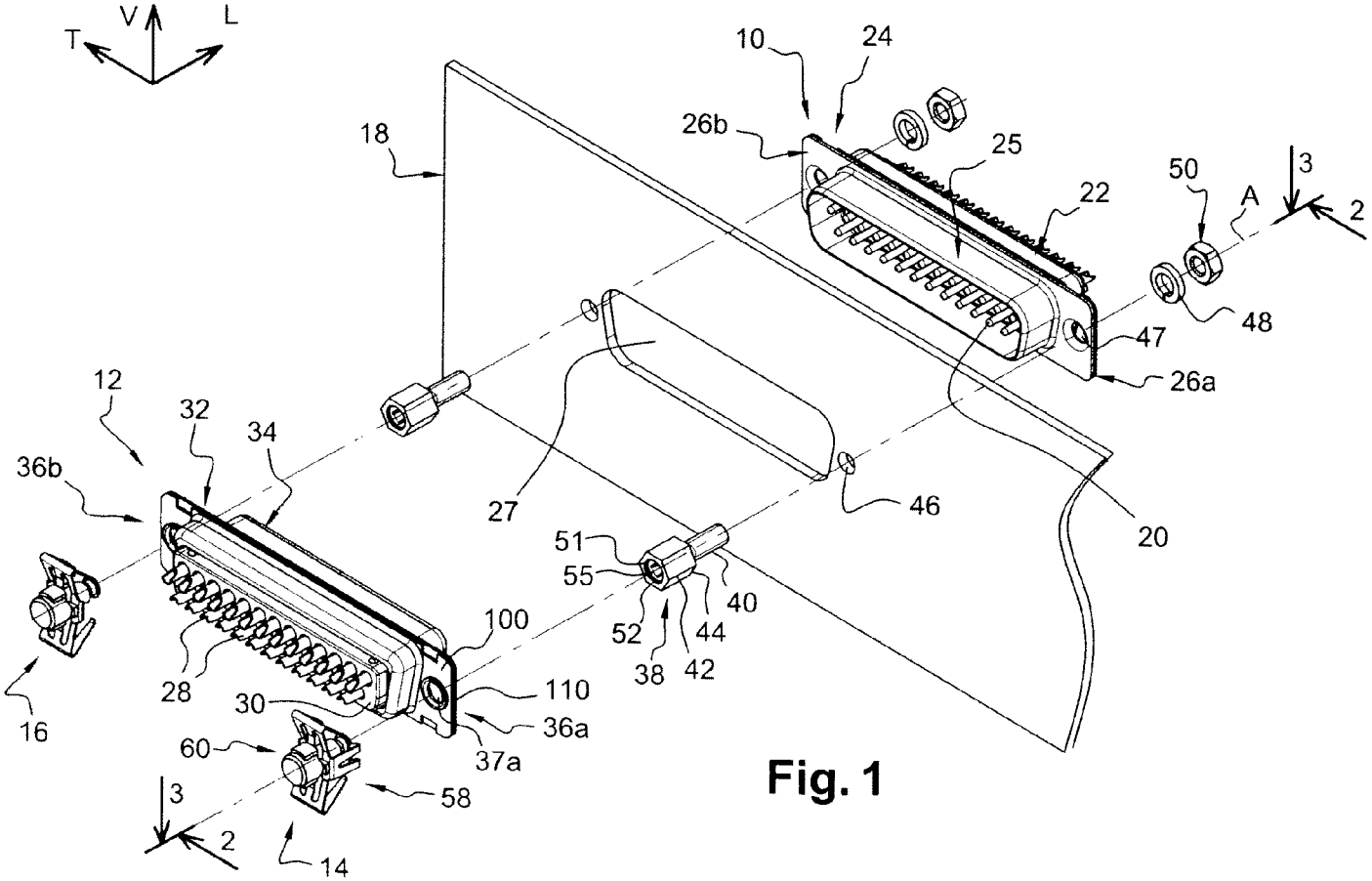
FIG. 1 illustrates an exploded general perspective view showing a first latching device and a second latching device of a first embodiment for latching a first connector and a second connector.

There is represented in FIG. 1 a first connector 10 at the front and a complementary second connector 12 at the rear that together may constitute a connector system. The first connector 10 may be carried by a plate 18 which is, for example, a back panel of a casing (not shown) of electrical or electronic equipment (not shown), such as a computer back panel. The first connector 10 may include a series of longitudinal contact pins 20 that are inserted into an insulative body 22 and project rearward and forward of the body 22.

The insulative body 22 may be surrounded by a metal shield 24 which defines a first lateral flange **26*a* opposite a second lateral flange 26*b* for fixing the first connector 10 to the plate 18. The shield 24 may also form a back connecting sleeve 25 that extends rearward of the body 22 through a hole 27 in the plate 18. The first connector 10 may be connected to a cable (not shown) for example that is composed of a bundle of electrically conductive wires each of which is connected to a contact pin 20**.

In a complementary way, the second connector 12 may include a series of contact receptacles 28, each of which may be inserted into an insulative body 30 so as to be able to receive an associated contact pin 20 of the first connector 10. The second connector 12 may connect to a cable (not shown), for example, that is composed of a bundle of electrically conductive wires each of which is connected to a contact receptacle 28. The insulative body 30 of the second connector 12 may be surrounded by a metal shield 32 which may define a first lateral flange **36*a* opposite a second lateral flange 36*b* and may include a front section 34 intended to be received in the rear sleeve 25 of the shield 24 of the first connector 10**.

Here, the connector system is of the D-Sub type, i.e. the rear sleeve 25 of the first connector 10 and the front section 34 of the second connector 12 each have a D-shaped section constituting polarizing means when connecting up the connector system. The connector system consisting of the two complementary connectors may be furnished with a first latching device 14 and a second latching device 16 for latching the first connector 10 onto the second connector 12. The latching devices 14, 16 may be structurally independent of the male electrical contact elements 20 and the female electrical contact elements 28. The first latching device 14 and the second latching device 16 may be identical and may be symmetrically arranged about a longitudinal and vertical first median general plane of symmetry.

Figure 2:
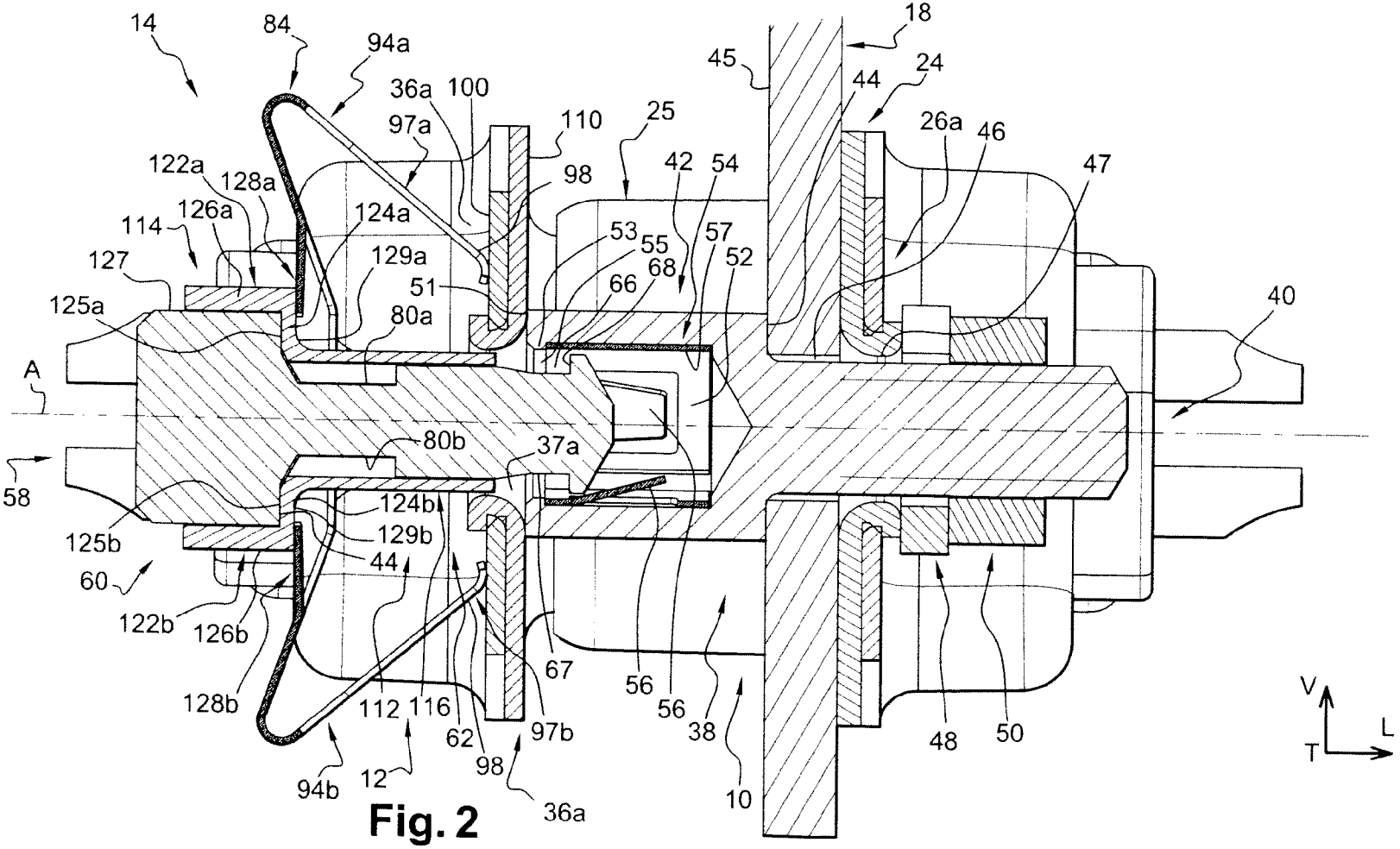
FIG. 2 illustrates a view in section taken along the line 2-2 in FIG. 1 showing the first connector connected to the second connector and the first latching device, a female element of which is fixed to the first connector and a male element of which carried by the second connector is in a rear rest position according to an embodiment.

Consequently, only the first latching device 14 is described in the remainder of the description. The description of the second latching device 16 may be deduced from that of the first device 14. In a first embodiment, as can be seen in FIGS. 1 and 2, the first latching device 14 may include a female element 38 that is fixed to the first connector 10, to be more precise, to the flange 26*a* of the shield 24. The first latching device 14 may have a second vertical longitudinal plane of symmetry that passes through the axis A. The female element 38 may extend longitudinally along the axis A and may include a section 40 at the front for removably attaching it to the first connector 10 and a latching section 42 at the rear.

As can be seen in FIG. 2, the front fixing section 40 may be a threaded rod that extends along the axis A from a shoulder 44 of the rear latching section 42, through a hole 46 in the plate 18 and through a hole 47 in the first lateral flange 26*a* of the shield 24 of the first connector 10. The shoulder 44 may bears axially against a rear face 45 of the plate 18, and the front fixing section 40 may cooperate with a washer 48 and a nut 50 such that the female element 38 is fixed to the first connector 10 and retains the first connector 10 on the plate 18. The latching section 42 at the rear of the female element 38 may be of a hollow hexagonal shape, delimiting a cylindrical housing 52 along the axis A that opens axially and rearwardly via an orifice 55 on a radial rear face 51 of the rear latching section 42. The housing 52 may include a cylindrical bush 54 along the axis A that cooperates with the concave internal wall 57 of the housing 52 and the bush 54 is retained axially in the housing 52 by means of an annular rear rib 53 that delimits radially the entry orifice 55 of the housing 52.

The bush 54 may be slit axially in order to be inserted into the housing 52 through the entry orifice 55 by deforming elastically. The bush 54 may include three trapezoidal retaining fingers 56 that are regularly arranged in the circumferential direction around the axis A and each of which extends obliquely in the back to front direction toward the axis A of the housing 52, as FIG. 1 shows for two of the three fingers 56. Here, the bush 54 may be produced in sheet metal and the retaining fingers 56 may be produced by cutting and bending the bush 54.

Figure 3:
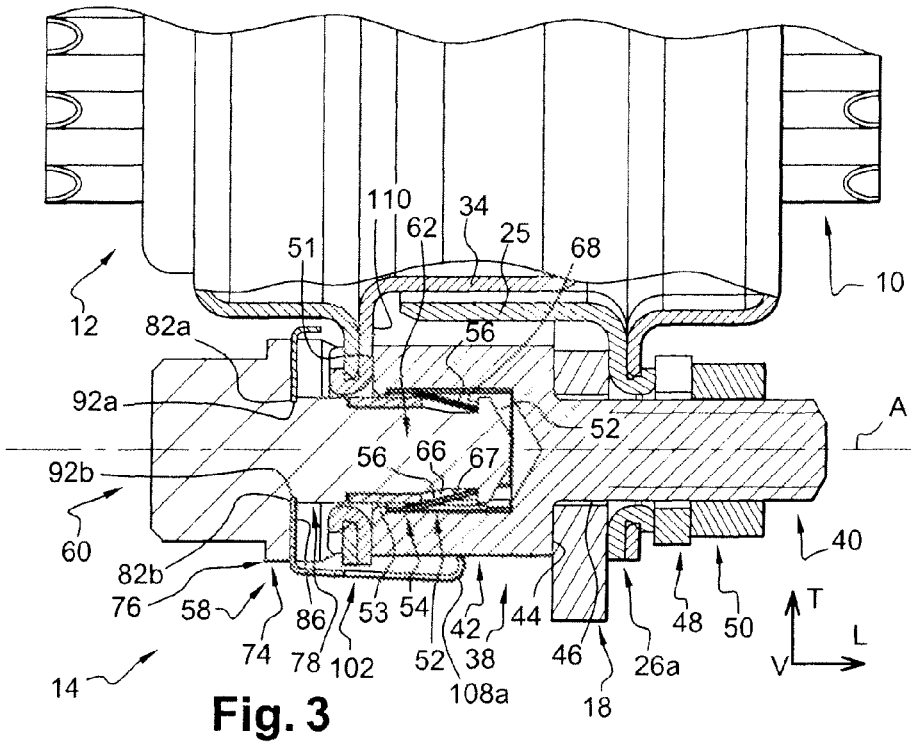
FIG. 3 illustrates a view in section taken along the line 3-3 in FIG. 1 showing the first connector connected to the second connector and the male element of the first latching device in a front latching position according to an embodiment.

The first connector 10 and the second connector 12 are shown in a connected position in FIGS. 2-5, in which position the rear sleeve 25 of the first connector 10 may receive the front section 34 of the second connector 12, as FIG. 3 shows, and the contact pins 20 may be received in the contact receptacles 28. In this connected position, the radial front face 110 of the first flange 36*a* of the second connector 12 may bear axially against the radial rear face 51 of the rear latching section 42 of the female element 38 such that the orifice 55 of the housing 52 of the female element 38 may be arranged coaxially with the orifice 37*a* of the first flange 36*a* of the second connector 12.

As FIGS. 1 and 2 show, the first latching device 14 may include a male element 58 that is intended to be latched into the associated female element 38. The male element 58, as shown in detail in FIGS. 6-9, may have a cylindrical general shape along the axis A and may include a latching section 62 at the front, a radially projecting head 60 at the rear and an intermediate section 74 disposed axially between the head 60 and the latching front section 62. The latching front section 62 may have at its front end a retaining notch 66 in the form of an annular cylindrical groove the axis of which is the axis A. The retaining notch 66 may be delimited by an annular radial rear face 68 and an axial section 67 that extends from the rear face 68 and an overall section that increases rearward.

Figure 6:
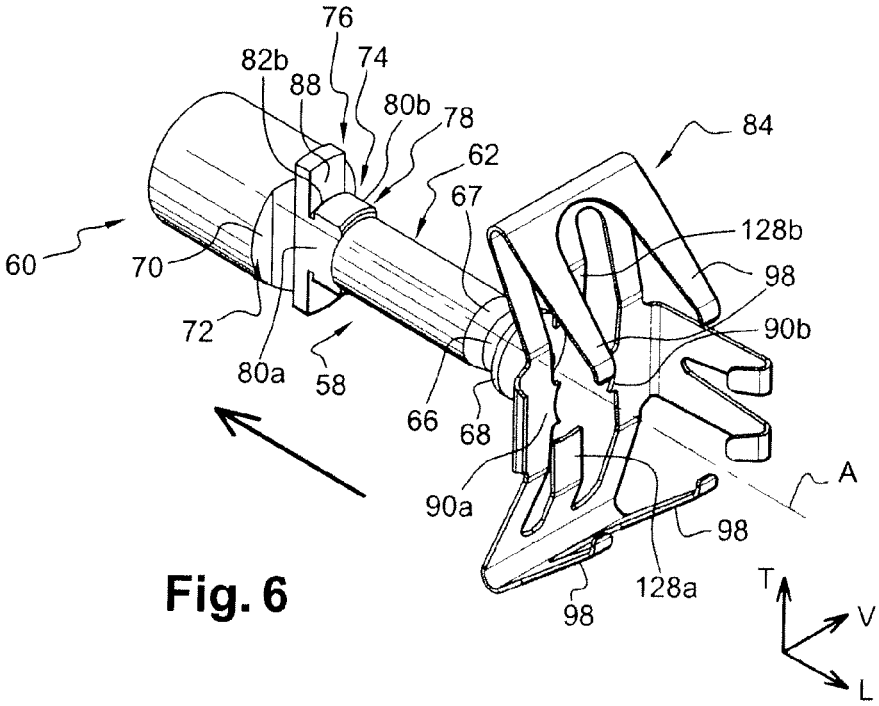
FIG. 6 illustrates a detail perspective view showing a first step of mounting a multifunction spring axially on the male element according to an embodiment.

As FIG. 6 shows, the shape of the rear head 60 of the male element 58 may be a cylinder the axis of which is the axis A and which includes a shoulder 72 having a radial front face 70 connected to the intermediate section 74. The intermediate section 74 may have a T-shaped axial section and may include an axial branch 78 that is connected to the latching front section 62 and a transverse radial branch 76 that is connected to the shoulder 72 of the rear head 60, the transverse radial branch 76 projecting radially to either side relative to the head 60. The T-shaped intermediate section 74 may be delimited laterally by a T-shaped first flat 80*a* and a parallel T-shaped second flat 80*b* which extend in opposite axial directions along the axis A.

Additionally, the intermediate section 74 may include a first groove 82*a* radially opposite a second groove 82*b*. Each groove 82*a*, 82*b* may form an arc the axis of which is the axis A and each of which extends from the first flat 80*a* to the second flat 80*b* at the junction of the transverse branch 76 and the axial branch 78, respectively, of the T-shaped intermediate section 74. The male element 58 may be carried by the second connector 12 to which it is connected by means of a multifunction spring 84.

Figure 11:
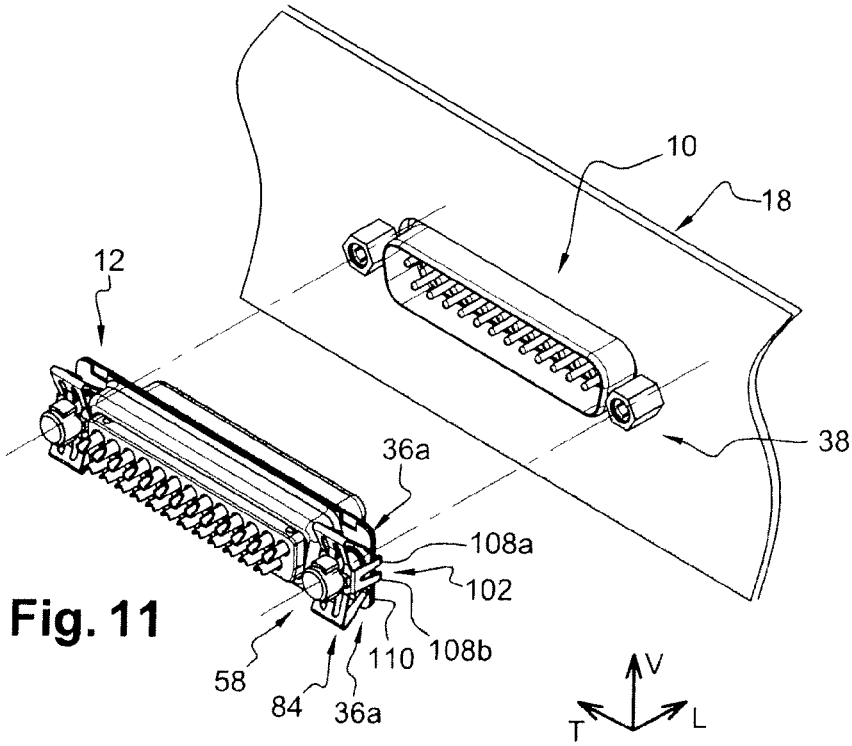
FIG. 11 illustrates a perspective view showing the first connector disconnected from the second connector according to an embodiment.

To be more precise, the male element 58 may be carried by the flange 36*a* of the shield 32 of the second connector 12 in a rearward rest position shown in FIGS. 2 and 11 in which the latching front section 62 of the male element 58 extend axially through an orifice 37*a* in the first flange 36*a* of the second connector 12. The male element 58 may mount to slide in the direction from the rear to the front, from its rear rest position, to which the male element 58 is elastically urged at all times by the multifunction spring, to a front latching position in the female element 38. The multifunction spring 84, as shown in detail in FIG. 12, may be made in one piece from sheet metal cut and bent to shape, and may be removably mounted on the male element 58. To this end, the multifunction spring 84 may include a radial central portion 86 that is cut so as to delimit a first blade 90*a* and a second blade 90*b* for connection to the male element 58. The connection blades 90*a*, 90*b* may extend face-to-face and radially toward the axis A and each may includes a respective edge 92*a*, 92*b* in the shape of a circular arc the axis of which is the axis A.

As FIGS. 3-9 show, each edge 92*a*, 92*b* may cooperate with the respective groove 82*a*, 82*b* of the T-shaped intermediate section 74 in order to retain the multifunction spring 84 on the male element 58. The central portion 86 of the multifunction spring 84 here may bear axially on a radial front face 88 of the transverse branch 76 of the T-shaped intermediate section 74. The multifunction spring 84 may include an elastically deformable first prong 94*a* and an elastically deformable second prong 94*b* constituting first rearward spring return means of the male element 58. The first return prong 94*a* and the second return prong 94*b* may be arranged symmetrically and diametrally opposed with respect to the axis A and are disposed axially between the T-shaped intermediate section 74 and a radial rear face 100 of the first flange 36*a* of the second connector 12.

As FIG. 2 shows, the first prong 94*a* and the second prong 94*b* may each be V-shaped and bent radially outward, with a rear branch 95*a*, 95*b* connected to the central portion 86 of the multifunction spring 84 and a respective front branch 97*a*, 97*b* bearing axially on the radial rear face 100 of the first flange 36*a* of the second connector 12. To be more precise, each front branch 97*a*, 97*b* may be U-shaped, each arm of which constitutes a base 98 that bears axially on the radial rear face 100 of the first flange 36*a*. Accordingly, when the male element 58 is driven forward from its rear rest position, each V-shaped prong 94*a*, 94*b* may compress and bend elastically to urge the male element 58 rearward. Additionally, the multifunction spring 84 may include a catch 102 for attaching the male element 58 to the second connector 12, which may be adapted to oppose the return spring force exerted by the two V-shaped prongs 94*a*, 94*b* in order to retain the male element 58 in its rear rest position, as shown in FIG. 11, such that the assembly formed by the multifunction spring 84 and the male element 58 is captive on the second connector 12.

To this end, the catch 102 may extend axially forward from the central portion 86 of the multifunction spring 84, the catch 102 being disposed between the two V-shaped prongs 94*a*, 94*b*. The catch 102 may include a central cut-out that delimits a first axial attachment branch 106*a* and a second axial attachment branch 106*b*, each of which may defines a respective hook 108*a*, 108*b* at its free end. Each hook 108*a*, 108*b* may curve rearward such that it is adapted to cooperate with a radial front face 110 of the first flange 36*a* of the second connector 12, as shown in FIG. 11. The catch 102 may be advantageously elastically deformable to enable it to be fitted.

As FIG. 2 shows, when the male element 58 occupies its rear rest position, its latching front section 62 may extend axially through the orifice 37*a* in the first flange 36*a* of the second connector 12 and partly into the housing 52 of the female element 38. The head 60 of the male element 58 is to the rear of the flange 36*a*. Accordingly, the latching section 62 of the male element 58 may be adapted to be moved from its rear rest position to its front latching position such that it is inserted into the housing 52 of the female element 38 in order to latch the first connector 10 to the second connector 12. When the latching section 62 occupies its latching front position shown in FIGS. 3, 4, 5 and 10, the retaining fingers 56 that extend into the housing 52 of the female element 38 may elastically deform outward as the latching section 62 passes them before being received in the notch 66 of the latching section 62 of the male element 58.

To be more precise, the free front end of each finger 56 may bear axially on the rear face 68 of the notch 66 and the fingers 56 thus oppose rearward withdrawal of the male element 58. Additionally, the multifunction spring 84 here may constitute means for taking up play between the male element 58 and the female element 38 by constantly urging the male element 58 elastically rearward such that the retaining fingers 56 remain pressed axially onto the rear face 68 of the notch 66.

Figure 9:
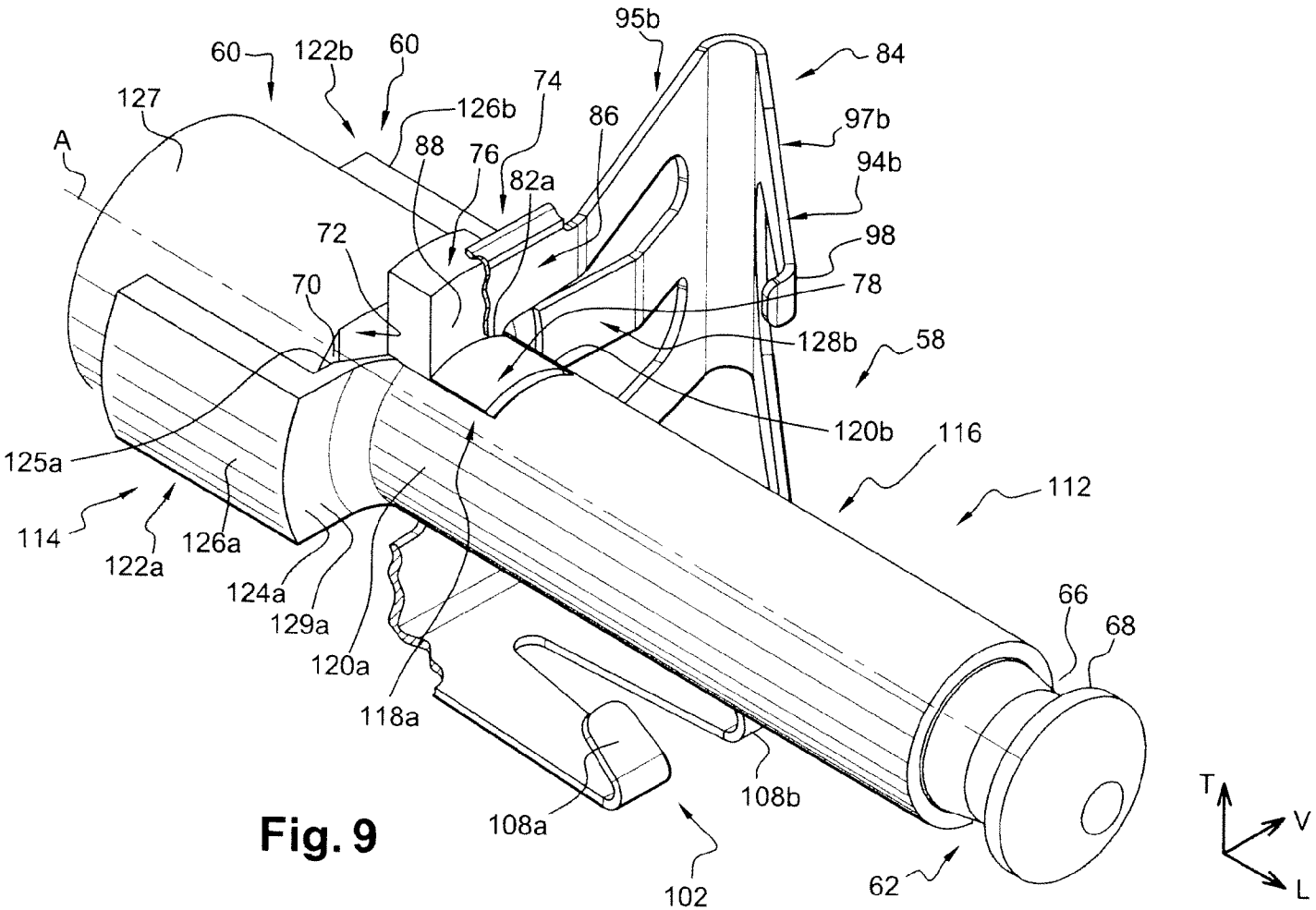
FIG. 9 illustrates a detail perspective view, partially cut away, showing an assembly formed by the male element, the multifunction spring and the unlatching member according to an embodiment.
Figure 10:
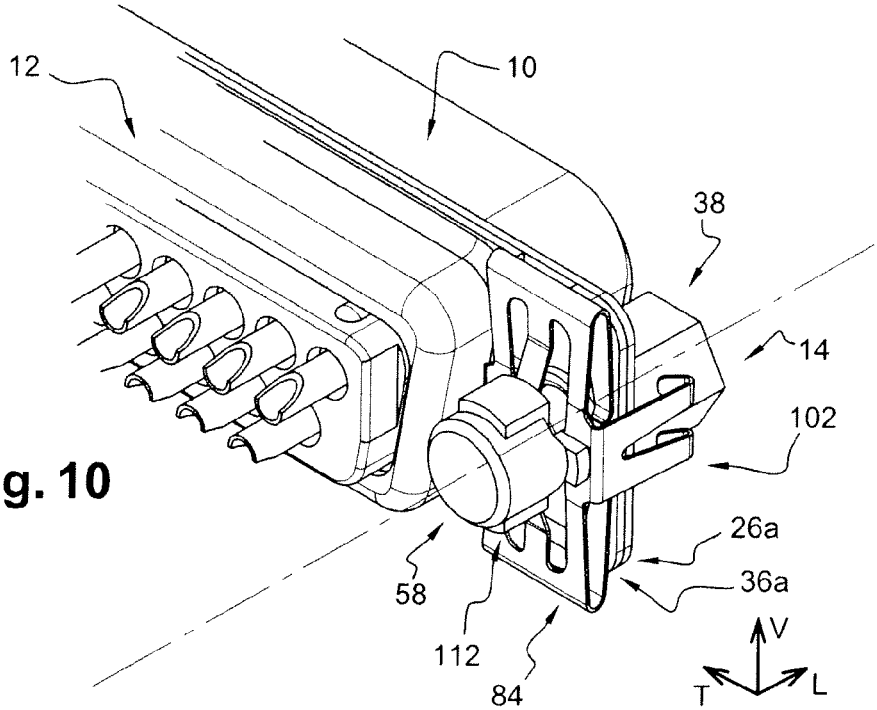
FIG. 10 illustrates a partial perspective view showing the male element in its forward latching position according to an embodiment.

As may be seen in FIGS. 2 and 9, the latching device 14 may include an unlatching member 112 mounted on the male element 58. The unlatching member 112 may be a sheath of globally cylindrical shape complementary to that of the male element 58 which includes an actuating rear section 114 and an unlatching front section 116. The unlatching front section 116 may be a cylinder opened up from end to end by an axial slot 117 to enable the unlatching member 112 to be fitted onto the male element 58 by axial elastic spreading of the unlatching front section 116. The axial rear end of the unlatching front section 116 may include a first axial notch 118*a* and a second axial notch 118*b* that are symmetrical and diametrally opposed and which receive between them the T-shaped intermediate section 74 of the male element 58, as shown in FIG. 9.

The notches 118*a* and 118*b* may be delimited by a first axial branch 120*a* and a second axial branch 120*b* that are diametrally opposed and respectively cooperate with the first flat 80*a* and the second flat 80*b* of the T-shaped intermediate section 74, thanks to which the unlatching member 112 may be linked to the male element 58 rotationally about the axis A. The rear actuating section 114 of the unlatching member 112 may extend rearward from the first axial branch 120*a* and the second axial branch 120*b* of the unlatching front section 116. The rear actuating section 114 may be shaped as a fork, a first branch 122*a* and a second branch 122*b* of which extend axially rearward and each forms an "L" shape. Each L-shaped branch 122*a*, 122*b* of the fork may have a radial portion 124*a*, 124*b* and an axial rear portion 126*a*, 126*b*. Each radial portion 124*a*, 124*b* may be connected to the unlatching front section 116 and includes a radial rear face 125*a*, 125*b* bearing axially against the radial front face 70 of the shoulder 72 of the head 60 of the male element 58.

Each axial rear portion 126*a*, 126*b* of the L-shaped branches 122*a*, 122*b* of the fork may have a concave internal face that cooperates with the complementary convex face 127 of the cylindrical head of the male element 58. Accordingly, each axial rear portion 126*a*, 126*b* may project radially relative to the head 60 and constitutes a pusher member 126*a*, 126*b* for driving the unlatching member 112 axially forward, as described hereinafter.

Figure 5:
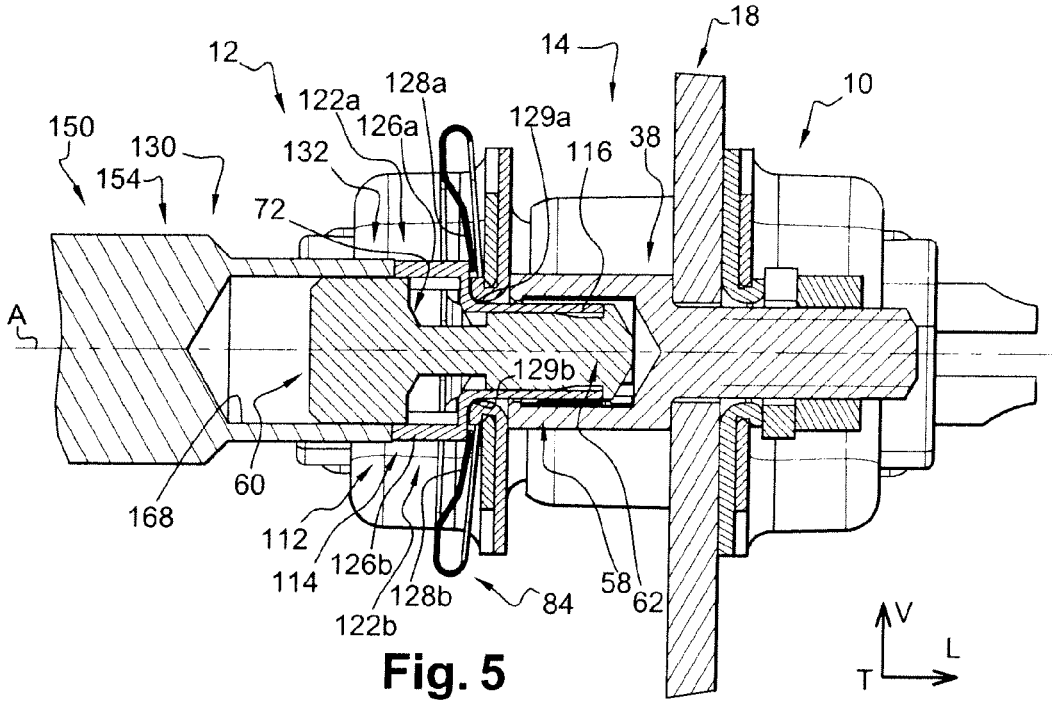
FIG. 5 illustrates a view similar to that of FIG. 2 showing the male element of the first latching device in its forward latching position and an unlatching member in a forward unlatching position according to an embodiment.

To this end, the unlatching member 112 may be mounted to slide axially on the male element 58 between a rear rest position represented in FIGS. 2, 3 and 9 and a first unlatching position represented in FIG. 5, in which the unlatching member 112 unlatches the first connector 10 from the second connector 12.

To be more precise, during movement of the unlatching member 112 toward its unlatching front position, the unlatching front section 116 may slide between the retaining fingers 56 and the latching section 62 of the male element 58 so as to retract the fingers 56 from the notch 66 in the radially outward direction such that the fingers 56 no longer cooperate with the notch 66 and no longer oppose rearward withdrawal of the male element 58. When the unlatching member 112 occupies its front unlatching position, the free front end of the unlatching section 116 may bear axially on the rear face 68 of the notch 66, which is then blocked, such that the unlatching front section 116 is disposed radially between the fingers 56 and the notch 66. Here the multifunction spring 84 may constitute second return spring means for urging the unlatching member 112 toward its rear rest position.

Figure 12:
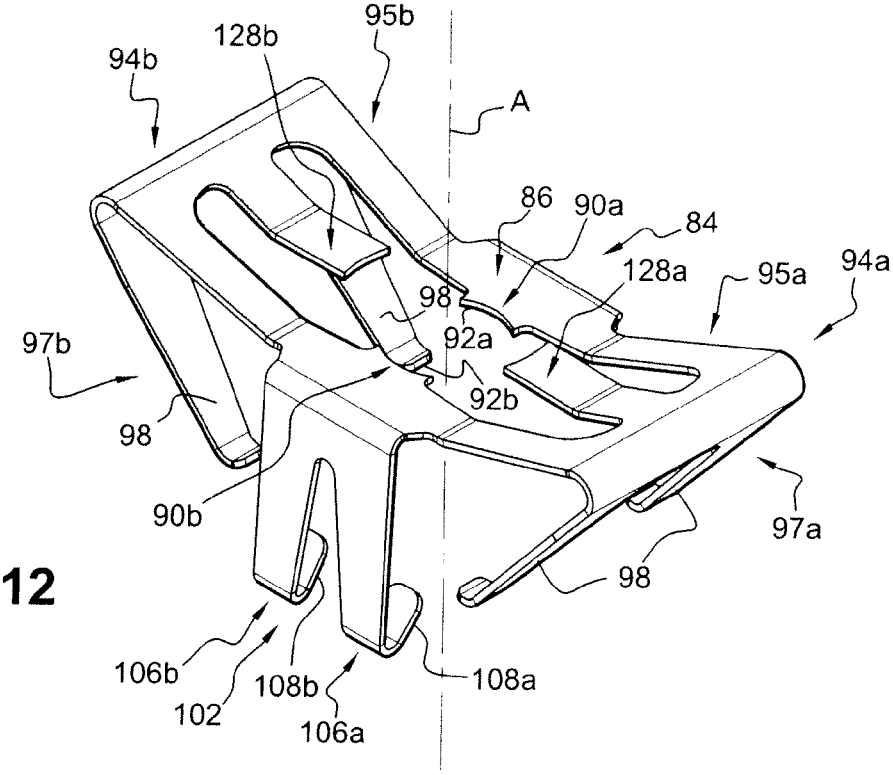
FIG. 12 illustrates a detail perspective view showing the multifunction spring according to an embodiment.

To this end, as FIG. 12 shows, the multifunction spring 84 may include a third return prong 128*a* and a fourth return prong 128*b* in the rear branch 95*a* of the first V-shaped prong 94*a* and in the rear branch 95*b* of the second V-shaped prong 94*b*, respectively. The third return prong 128*a* and the fourth return prong 128*b* may be elastically deformable, extend radially toward the axis A in a diametrally opposed manner and may be offset angularly by 90° relative to the first connection blade 90*a* and the second connection blade 90*b* of the multifunction spring 84.

Figure 4:
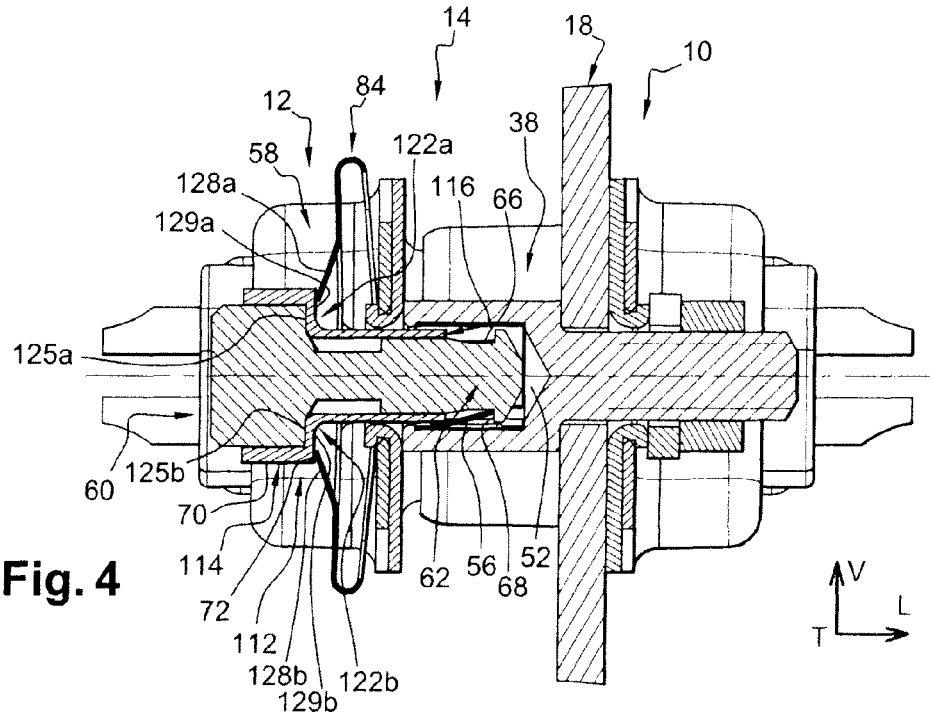
FIG. 4 illustrates a view similar to that of FIG. 2 showing the male element of the first latching device in its forward latching position according to an embodiment.

As FIGS. 2, 4 and 5 show, the third return prong 128*a* and the fourth return prong 128*b* may respectively bear axially against a radial front face 129*a* of the first branch 122*a* and a radial front face 129*b* of the second branch 122*b* of the unlatching member 112 in order to urge the unlatching member 112 constantly rearward.

The remainder of the description describes an example of the operations to be effected to latch the first connector 10 to the second connector 12 by means of the first latching device 14. It should be noted the latching operations for the second latching device 16 are identical. Assuming that the various elements of the first latching device 14 have not been assembled, a preliminary assembly operation is necessary.

Figure 7:
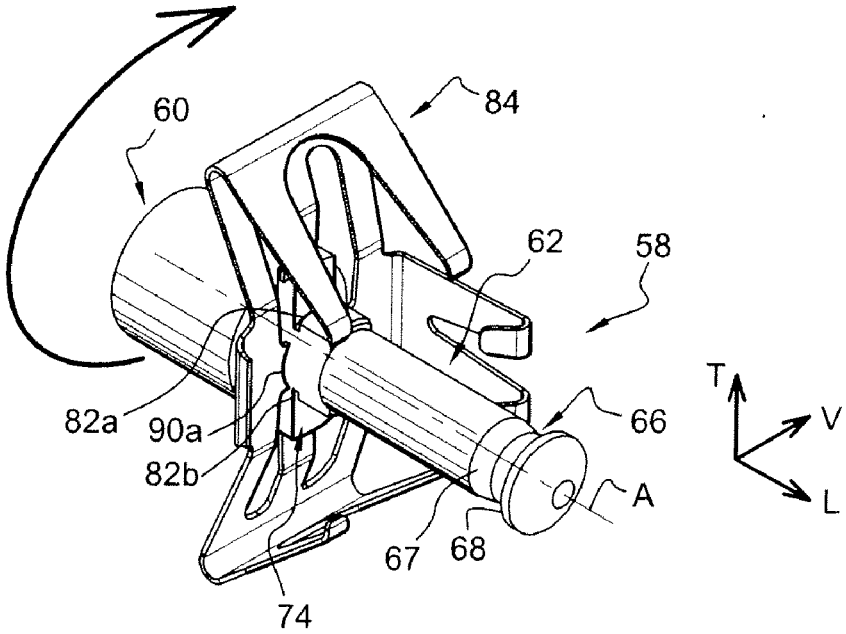
FIG. 7 illustrates a view similar to that of FIG. 6 showing a second step of mounting the multifunction spring on the male element bayonet fashion according to an embodiment.
Figure 8:
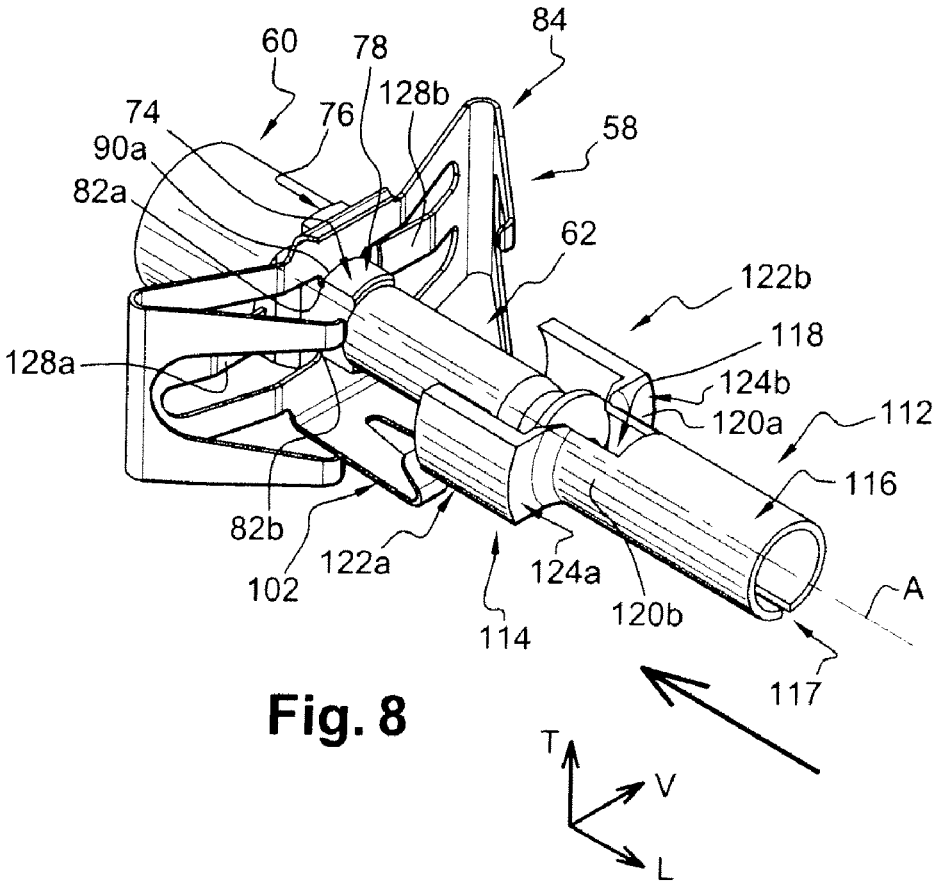
FIG. 8 illustrates a view similar to that of FIG. 6 showing a third step of mounting the unlatching member axially on the male element according to an embodiment.

As can be seen in FIGS. 6-8, the multifunction spring 84 may be fixed to the male element 58 by means of a bayonet-type mounting. To this end, the multifunction spring 84 may engaged axially along the latching front section 62 of the male element 58 via the radial central portion 86 of the spring 84, as FIG. 6 shows. The spring 84 may be driven to pivot one quarter-turn around the axis A such that the first connection blade 90*a* and the second connection Made 90*b* of the spring 84 respectively cooperate with the grooves 82*a*, 82*b* of the T-shaped intermediate section 74 of the male element 58 in order to retain the multifunction spring 84 on the male element 58, as can be seen in FIG. 7.

As FIG. 8 shows, the unlatching member 112 may engage axially over the latching front section 62 of the male element 58 until the unlatching member 112 reaches its rear rest position shown in FIG. 9 in which the third return prong 128*a* and the fourth return prong 128*b* may bear axially against the radial portions 124*a*, 124*b*, respectively, of the first branch 122*a* and the L-shaped second branch 122*b* of the unlatching member 112.

After this preliminary assembly operation, the assembly formed by the male element 58, the unlatching member 112 and the multifunction spring 84 may be mounted on the second connector 12 by means of the catch 102 of the multifunction spring 84 such that the male element 58 occupies its rear rest position. To this end, the latching front section 62 of the male element 58 may axially engage in part in the orifice 37*a* of the first flange 36*a* of the second connector 12 and the catch 102 of the multifunction spring 84 is arranged such that each of its two hooks 108*a*, 108*b* cooperates with the radial front face 110 of the first flange 36*a*, as FIG. 11 shows. The female element 38 may be fixed to the first connector 10 in a manner such as that described above.

After connecting the first connector 10 and the second connector 12 to each other, the male element 58 may be driven axially in the rear to front direction from its rear rest position to its front latching position in which the first connector 10 is latched to the second connector 12. To unlatch the first connector 10 from the second connector 12, the unlatching member 112 may be driven axially in the rear to front direction from its rear rest position to its front unlatching position.

The assembly formed by the male element 58 and the unlatching member 112 may then be urged elastically rearward by the first return prong 94*a* and the second return prong 94*b* of the multifunction spring 84 until the male element 58 reaches its rear rest position. Finally, the unlatching member 112 may be released and urged elastically toward its rear rest position by the third return prong 128*a* and the fourth return prong 128*b* of the multifunction spring 84. It may then be possible either to disconnect the first connector 10 from the second connector 12 or to latch the first connector 10 to the second connector 12 again.

In a variant (not shown) of the first embodiment, the first latching device 14 may include an actuating knurled wheel for driving axial sliding of the unlatching member 112 along the axis A by turning the knurled wheel. To this end, the axial rear portion 126*a* of the third branch 122*a* and the axial rear portion 126*b* of the fourth branch 122*b* of the unlatching member 112 may each include a threaded external convex face adapted to cooperate with a complementary threaded concave internal face of the knurled wheel. The knurled wheel may be mounted on the head 60 of the male element 58 to rotate freely about the axis A such that when it is rotated, for example by a quarter-turn, the unlatching member 112 may be driven to slide axially forward or rearward.

Figure 13:
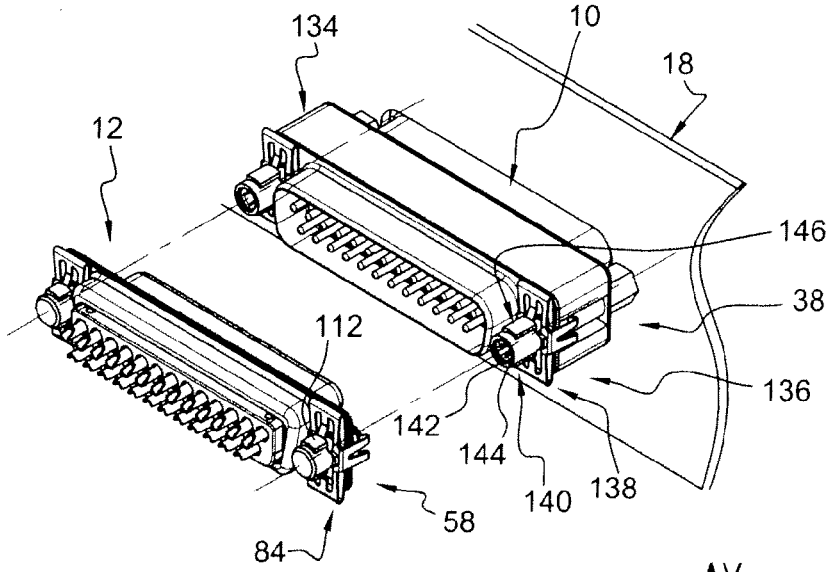
FIG. 13 illustrates a perspective view showing a second embodiment of the FIG. 2 device in which an intermediate adapter connector is latched to the female element by means of an additional male element according to an embodiment.
Figure 14:
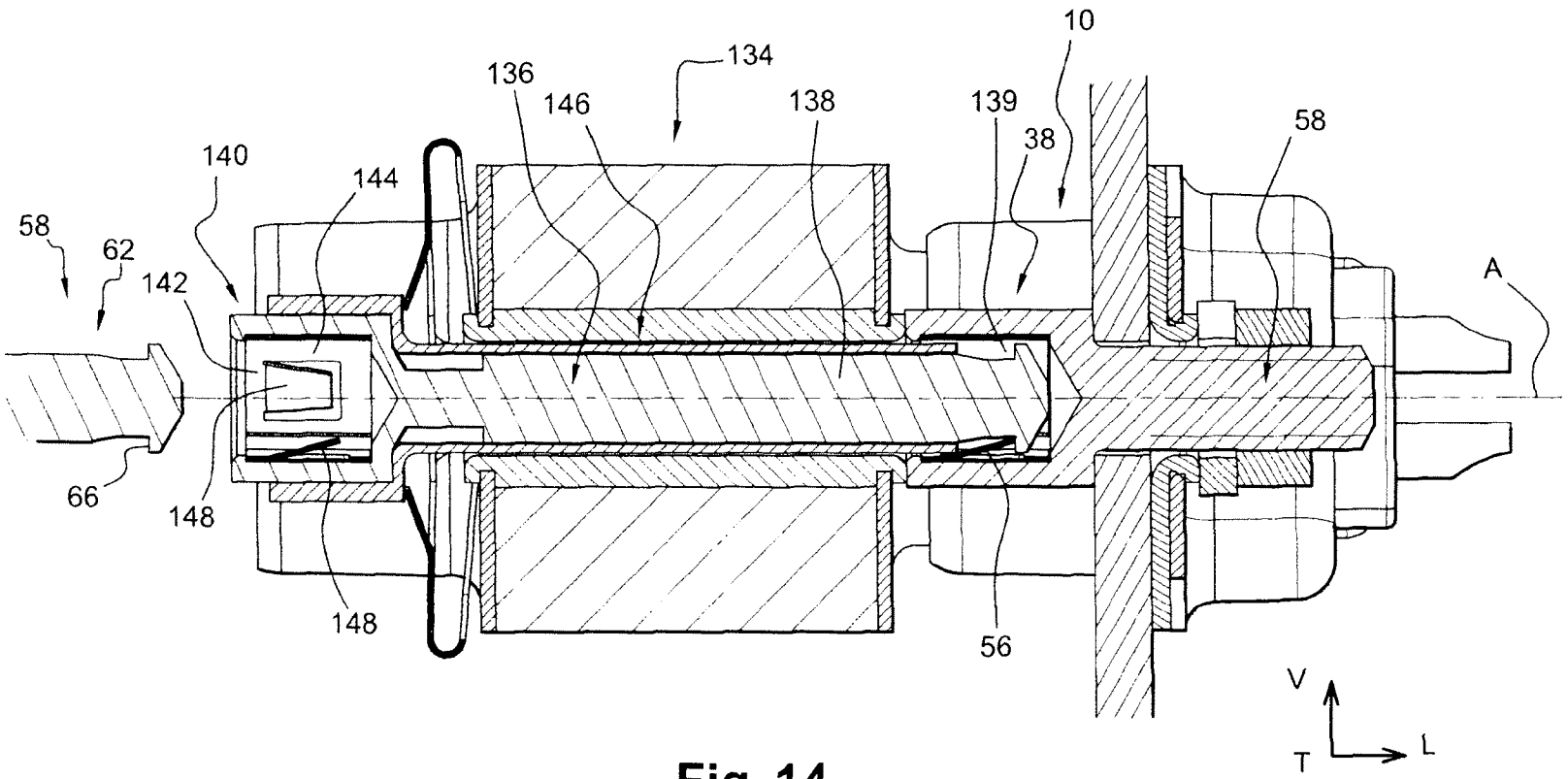
FIG. 14 illustrates a view in axial section showing the additional male element of the FIG. 13 device according to an embodiment.

In a second embodiment shown in FIGS. 13 and 14, the first latching device 14 may include an additional male element 136 that is carried by a third connector 134. For clarity, the term additional is used hereinafter to designate the various elements of the additional male element 136.

The third connector 134 may be of the adapter type and may connect the first connector 10 to the second connector 12, for example if the first connector 10 and the second connector 12 are both male connectors or both female connectors. In the same manner as for the male element 58 described above, the additional male element 136 may include an additional latching front section 138 the front end of which is furnished with an additional retaining notch 139. Unlike the male element 58, the additional male element 136 may include an additional rear head 140 that delimits an additional housing 142 open axially rearward along the axis A. The additional housing 142 may include an additional bush 144 defining three additional retaining fingers 148 that are regularly arranged in the circumferential direction around the axis A and each of which extends axially and obliquely in the back to front direction toward the axis A of the additional housing 142.

Accordingly, the latching front section 62 of the male element 58 may be adapted to be inserted axially in the rear to front direction into the additional housing 142 until it reaches a latching position in which the additional retaining fingers 148 are received in the retaining notch 66 of the male element 58 to immobilize the second connector 12 on the third connector 134 in the axial direction. Similarly, the additional latching front section 138 may be adapted to be inserted axially in the rear to front direction into the housing 52 of the female element 38 until it reaches a latching position represented in FIG. 14 in which the retaining fingers 56 of the female element 38 may be received in the additional retaining notch 139 to immobilize the third connector 134 on the first connector 10 in the axial direction.

An additional unlatching member 146 may be mounted to slide axially on the additional male element 136 between the additional latching front section 138 and the retaining fingers 56 of the female element 38 between a rear rest position and a front unlatching position in which the additional unlatching member 146 may retract the retaining fingers 56 out of the additional notch 139 in order to unlatch the third connector 134 from the first connector 10.

Figure 17:
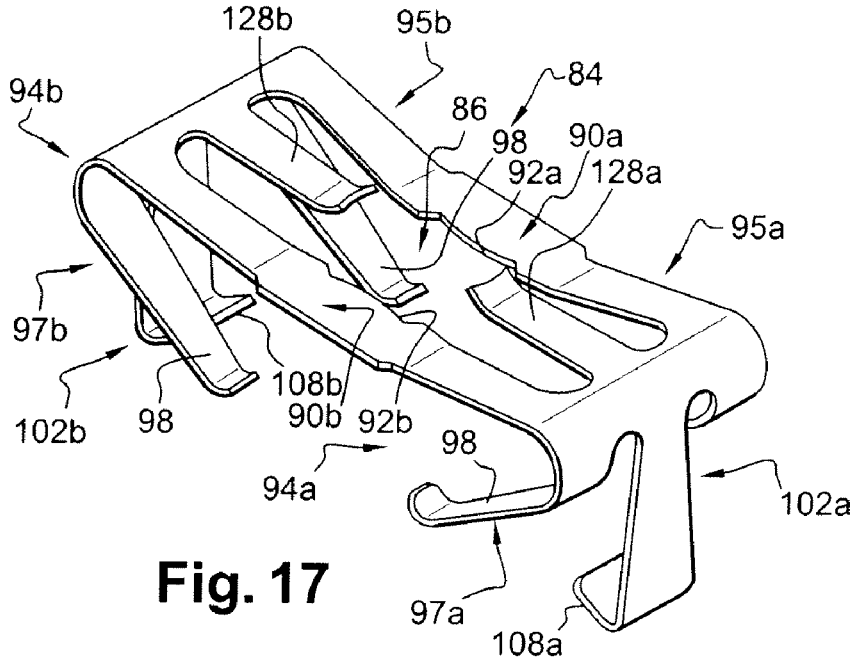
FIG. 17 illustrates a detail perspective view showing a different embodiment of the multifunction spring that includes two catches according to an embodiment.

In a variant of the embodiments described above, the multifunction spring 84 may include first and second prongs 102*a*, 102*b* for attaching the male element 58 to the second connector 12. In this variant, represented in FIG. 17, the first and second catches 102*a*, 102*b* may be disposed between the bases 98 of the front branches 97*a*, 97*b* of the two V-shaped prongs 94*a*, 94*b*, respectively.

The free end of each catch 102*a*, 102*b* may take the form of a respective hook 108*a*, 108*b* that is adapted to cooperate with the radial front face 110 of the first flange 36*a* of the second connector 12. By way of nonlimiting example, the multifunction spring 84 may include three catches, including a catch 102 disposed between the two V-shaped prongs 94*a*, 94*b* and two catches 102*a*, 102*b* that are disposed between the feet 98 of the front branches 97*a*, 97*b* of the two V-shaped prongs 94*a*, 94*b*, respectively. In a variant of the unlatching member 112 represented in FIG. 18, the section of the axial front end of the unlatching front section 116 may decrease substantially in the axial direction toward the front such that the front end of the unlatching section 116 is adapted to bear axially on the rear face 68 of the notch 66. Additionally, the unlatching front section 116 may include a first notch 117*a* and a second notch 117*b* that are symmetrical about the axis A and each of which extends axially rearward from the front end of the unlatching front section 116 to enable the unlatching member 112 to be mounted on the male element 58 by axial elastic spreading of the unlatching front section 116.

Figure 15:
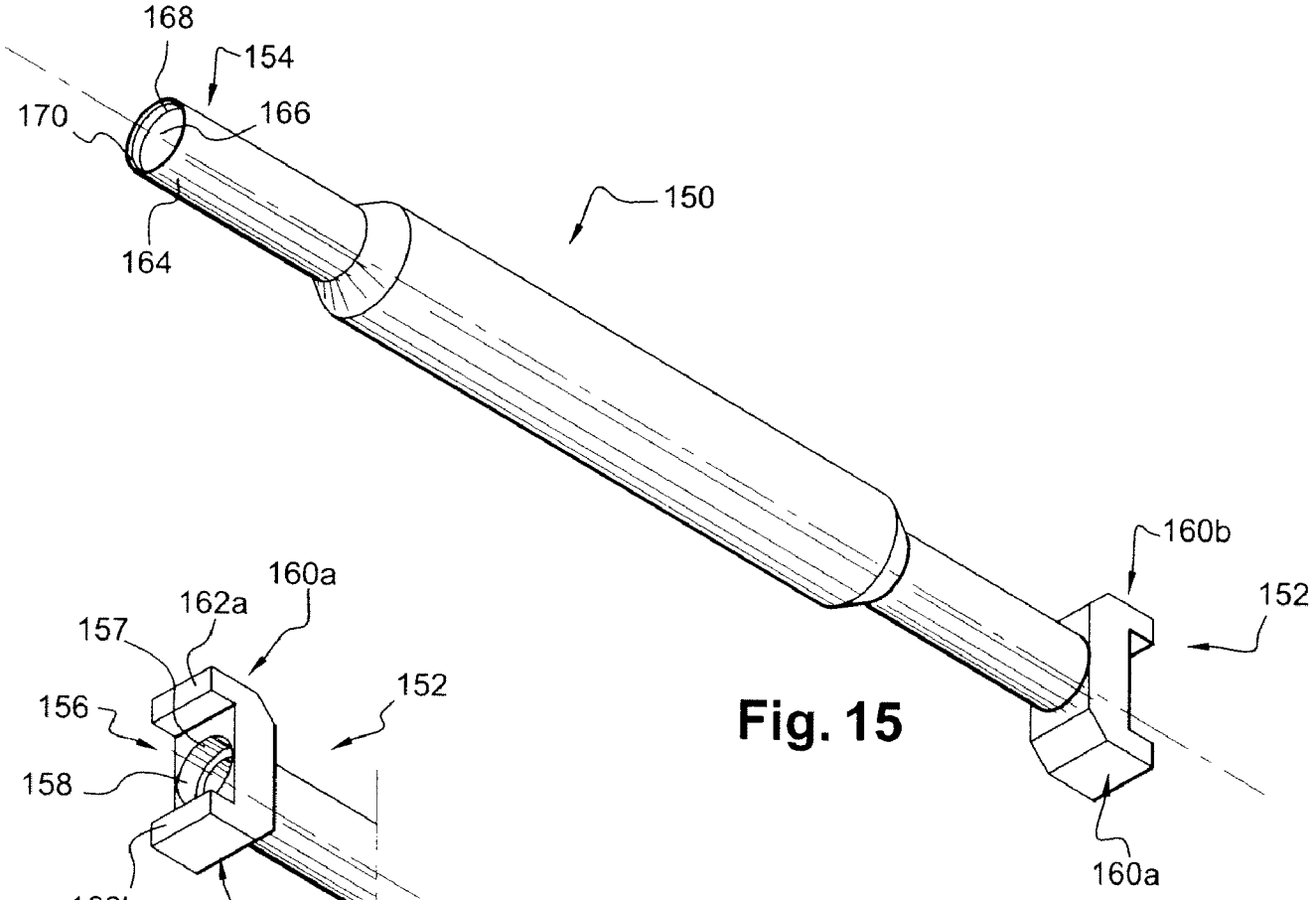
FIG. 15 illustrates a perspective view showing a multifunction tool including a tool for latching and unlatching the device according to an embodiment.
Figure 18:
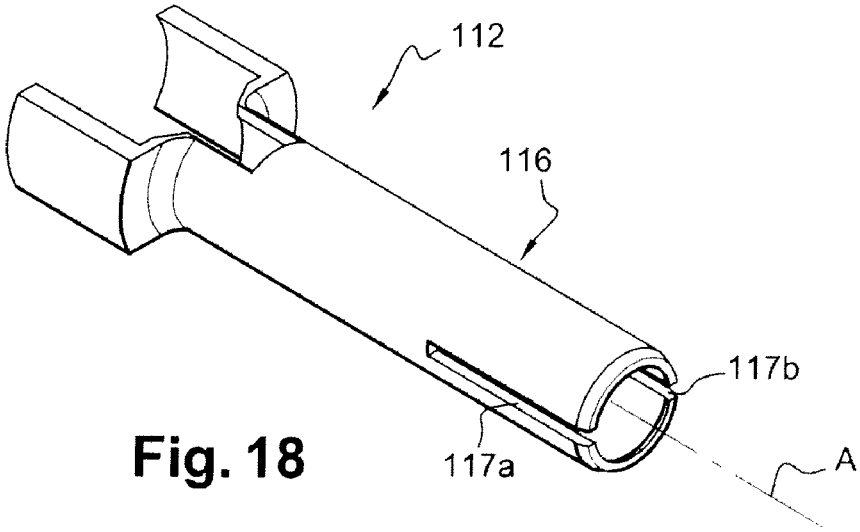
FIG. 18 illustrates a detail perspective view showing a different embodiment of the unlatching member with a forward unlatching end that includes two notches according to an embodiment.

In the variant of the unlatching member 112 represented in FIG. 18, each of the respective edges 92*a*, 92*b* of the connecting blades 90*a*, 90*b* may be a convex shape toward the interior of the perforated central portion 86. Each edge 92*a*, 92*b* may be adapted to cooperate with a complementary portion (not shown) of the T-shaped intermediate section 74 of the male element 58 in order to retain the multifunction spring 84 on the male element 58. According to another aspect, the first unlatching device 14 may be furnished with a multifunction tool 150 represented in FIG. 15. The multifunction tool 150 may be in the form of a rod of which a first axial end may include a tool 152 for latching the male element 58 and a second axial end may include a tool 154 for unlatching the male element 58.

Figure 16:
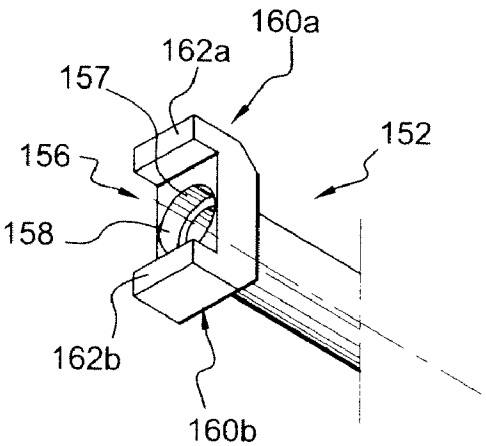
FIG. 16 illustrates a detail perspective view showing the FIG. 15 latching tool according to an embodiment.

As FIG. 16 shows, the latching tool 152 may include a tubular cylindrical portion 156 including an axial opening 157 and an internal concave wall 158 that is adapted to cooperate with the convex face 127 of the head 60 of the male element 58 in order to center the head 60 relative to the latching tool 152. The latching tool 152 may also include a fork of which a first arm 160*a* and a second arm 160*b* that are diametrally opposed extend axially forward from an external face of the tubular portion 156. The free end of each arm 160*a*, 160*b* may be delimited by a respective radial front face 162*a*, 162*b*. With the male element 58 in its rest position, the latching tool 152 may be engaged axially forward around the head 60 of the male element 58 such that the radial front faces 162*a*, 162*b* of the arms 160*a*, 160*b* bear axially against the rear branches 95*a*, 95*b* of the first V-shaped prong 94*a* and the second V-shaped prong 94*b* of the spring 84, which is fixed to the male element 58. Accordingly, the male element 58 may be driven axially forward to its front latching position by the latching tool 152 via the spring 184.

Here the latching tool 152 may drive the male element 58 precisely along the axis A of the housing 52 of the female element 38. The unlatching tool 154 of the multifunction tool 150 may include a tubular cylindrical portion 164 including an axial opening 166 and an internal concave wall 168 that is adapted to cooperate with the convex face 127 of the head 60 of the male element 58, as FIG. 5 shows. The axial opening 166 may be delimited by a radial edge 170 that cooperates with the free end of each pusher member 126*a*, 126*b* of the unlatching member 112 to drive the unlatching member 112 axially forward to its unlatching position. Additionally, the multifunction tool 150 may constitute an extender which facilitates latching and unlatching the device 14 is, for example if the device 14 is recessed and relatively inaccessible.

The latching device 14 may guarantee a secure connection. The latching device 14 may be designed such that the male element 58 cannot be latched in the female element 38 if the first connector 10 and the second connector 12 are not connected to each other or plugged in correctly. Similarly, the user may easily verify that the male element 58 is latched in the female element 38 and thus that the first connector 10 and the second connector 12 are correctly connected by visually inspecting the position of the rear head 60 of the male element 58 relative to the second connector 12 or by visually checking the state of the spring 84. The connection may also be checked by listening for the noise produced by the fingers 56 of the female element 38 when they drop into the retaining notch 66 of the male element 58. Additionally, if the multifunction spring 84 breaks, the male element 58 may remain locked in the female element 38.

In an embodiment that is not shown, the multifunction spring 84 may include a first catch that extends axially forward and is disposed transversely between the two U-shaped bases 98 of the front branch 97*a* of the first prong 94*a*. Likewise, the multifunction spring 84 may include a second catch that extends axially forward and is disposed transversely between the two U-shaped bases 98 of the front branch 97*b* of the second prong 94*a*.

Figure 19:
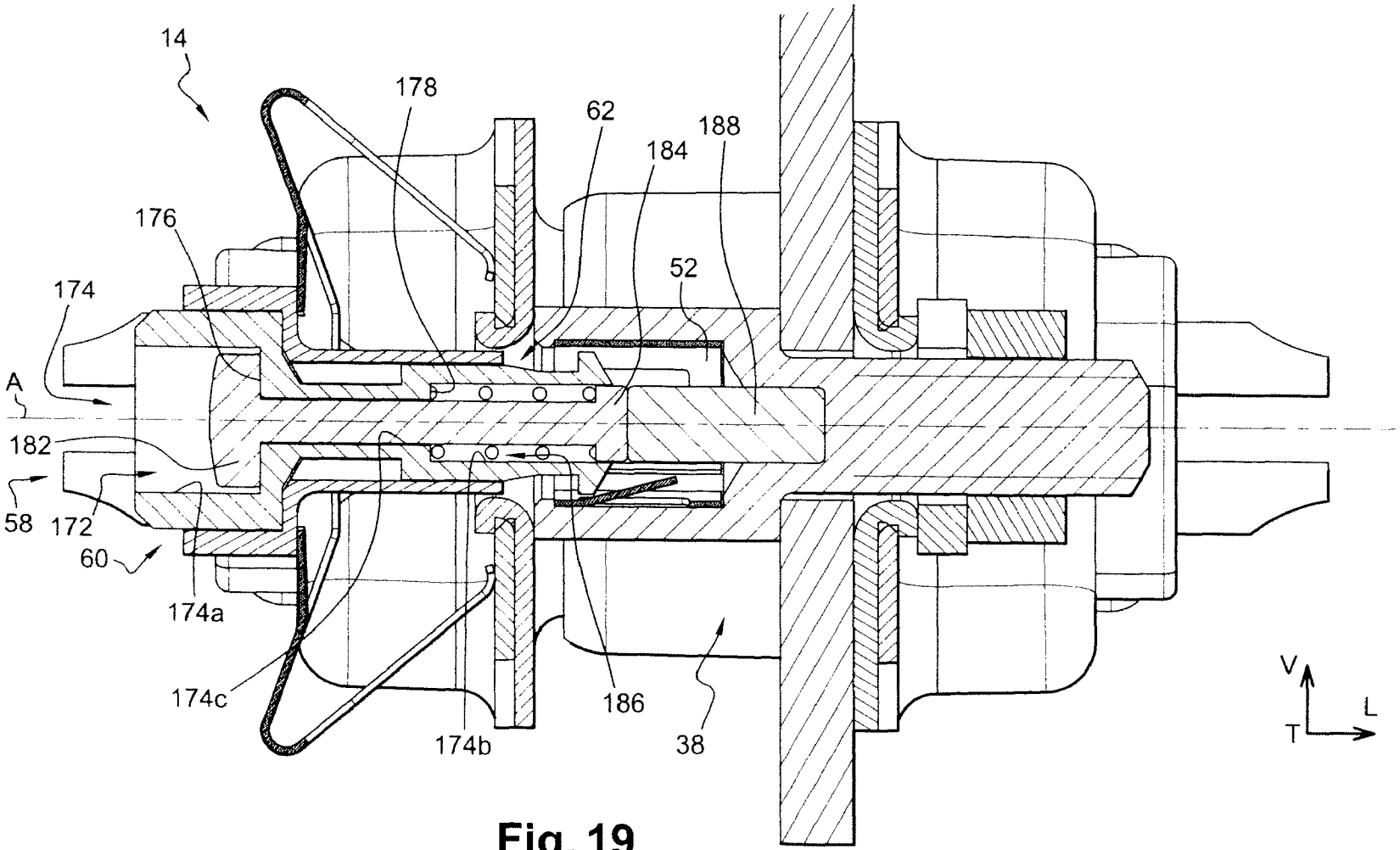
FIG. 19 illustrates a view in longitudinal section showing a visual indicator of a different embodiment of the invention in a forward position retracted into a well of the male element according to an embodiment.
Figure 20:
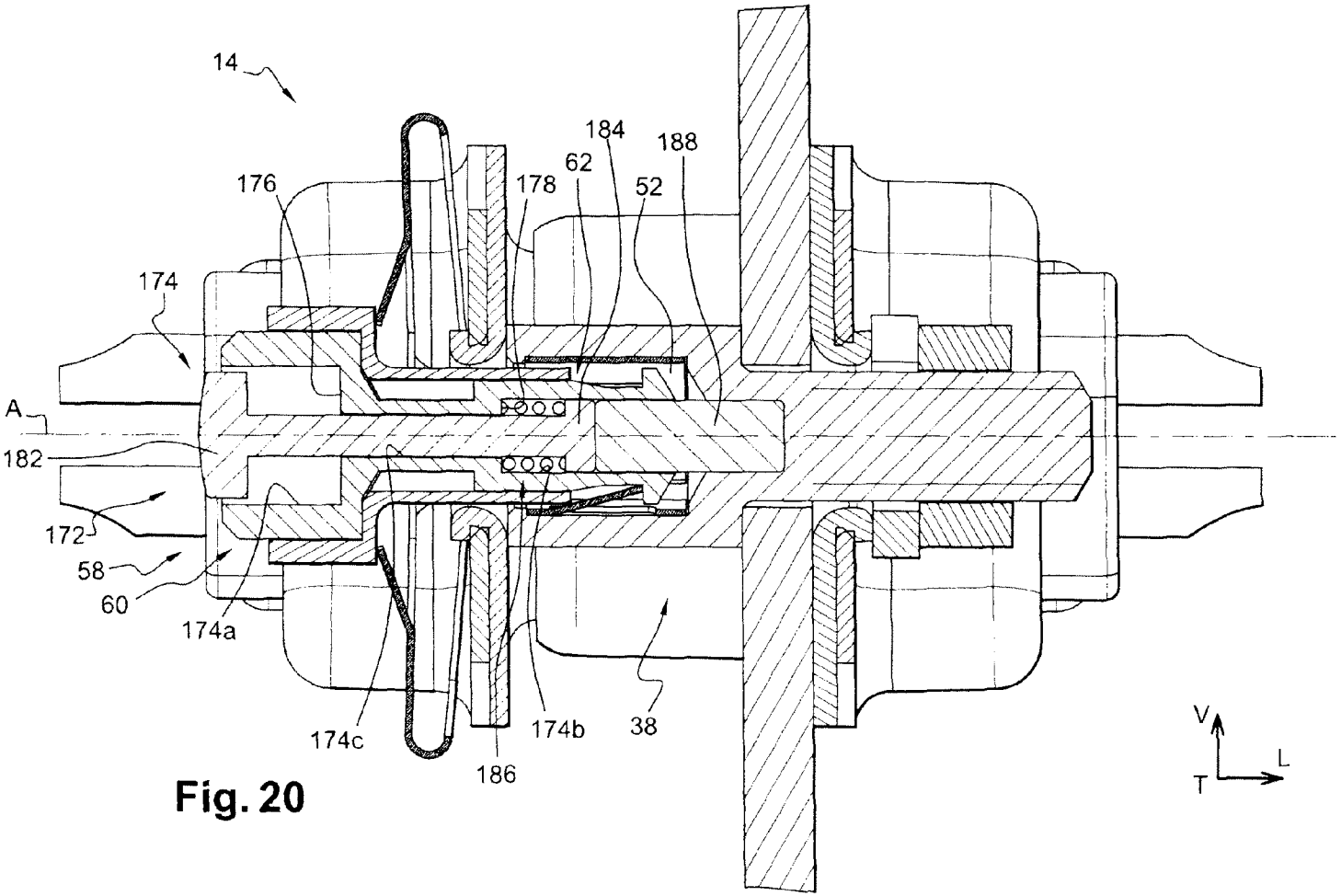
FIG. 20 illustrates a view similar to that of FIG. 19 showing the FIG. 19 visual indicator in a rearward indicating position according to an embodiment.

In another embodiment of the invention represented in FIGS. 19 and 20, the latching device 14 may include an indicator device enabling the user to check visually that the male element 58 is in its latching position in the female element 38. The indicator device may include a visual indicator 172 that extends longitudinally along the axis A in an open axial well 174 delimited by the male element 58. The well 174 may include a rear section 174*a* that is open in the axially rearward direction at a rear end of the head 60 of the male element 58 and delimited toward the front by a radial rear seat 176. Additionally, the well 174 may include a front section 174*b* that is open in the axially forward direction at a front end of the latching front section 62 of the male element 58 and delimited toward the rear by a radial front seat 178.

The well 174 may include an intermediate section 174*c* that extends axially from the rear section 174*a* to the front section 174*b*. In a complementary way, the indicator 172 may be in the form of a rod with a rear axial end that forms a rear indicator head 182 and a front end that forms a front driving head 184, each head 182, 184 projecting radially relative to the rod 180. The indicator 172 may be mounted to slide axially in the well 174 of the male element 58 between a retracted position represented in FIG. 19 and an indicating position represented in FIG. 20. When the indicator 172 occupies its retracted position, the rear indicating head 182 may bear in the axially forward direction on the rear seat 176 such that the rear indicator head 182 is hidden or concealed and the front head 184 is globally situated at the front end of the latching front section 62 of the male element 58.

The indicator 172 may be urged axially toward its retracted position by a return coil spring 186 disposed axially between the radial front seat 178 of the male element 58 and the front head 184 of the indicator 172. Conversely, when the indicator 172 occupies its indicating position, the rear indicating head 182 may project in the axially rearward direction relative to the rear section 174*a* of the well 174 such that the user is able to see the rear head 182 of the indicator 172. To this end, the indicator device may include a pin 188 that extends axially at the bottom of the housing 52 of the female element 38 such that an axial rear end of the pin 188 faces the front head 184 of the indicator 172.

Accordingly, when the male element 58 is moved forward from its rear rest position to its front latching position, the pin 188 may oppose movement of the indicator 172 such that the spring 186 is compressed and the indicator 172 occupies its indicating position when the male element 58 occupies its latching position. For example, the end face of the rear indicating head 182 may be red and visible axially. Alternatively, the lateral face of the rear head 182 may be green, is not visible in the rear indicating position and is visible in the front retracted position through a window provided for this purpose.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A device for latching a first connector to a complementary second connector, the device including:

a female element that is fixed to the first connector and delimits a housing open axially rearward;

at least one elastically deformable retaining finger that projects radially inside the housing of the female element; and a male element including a latching front section furnished with a retaining notch, the latching front section being adapted to be inserted axially from a rear of the device toward a front of the device, into the housing of the female element as far as a front latching position in which the retaining finger is received in the retaining notch to immobilize the first connector axially on the second connector, wherein the male element is carried by the second connector, the male element being mounted to slide from the rear of the device toward the front of the device, relative to the second connector from a rear rest position to a front latching position in the female element, and wherein the device includes an unlatching member that is mounted to the male element and is adapted to slide axially from the rear of the device toward the front of the device, between the latching front section and the finger, between a rear rest position and a front unlatching position in which the unlatching member retracts the retaining finger out of the notch.

2. The device of claim 1, wherein the retaining finger extends axially and obliquely from the rear toward the front toward the interior of the housing such that a free front end of the finger faces a radial rear face of the notch of the male element when the male element occupies a front latching position.

3. The device of claim 2, wherein the male element includes a first radial front face forming a shoulder from which a head extends rearward, the head of the male element being situated outside the housing when the male element occupies a latching position, and in that the unlatching member includes a radially projecting rear section, a radial rear face of which bears axially against the first radial front face of the male element when the unlatching member occupies a rear rest position.

4. The device of claim 1, wherein the second connector includes a radial flange that delimits a through-hole in which the male element is mounted to slide axially from the rear of the device toward the front of the device, and in that the device includes first return spring means adapted to urge the male element in a rearward direction.

5. The device of claim 4, wherein the male element includes a second radial front face that is offset angularly relative to a first radial front face and in that the first return spring means include at least one elastically deformable first return prong that is disposed axially between a rear face of the flange of the second connector and the second radial front face of the male element, the first return prong being V-shaped and bent radially outward.

6. The device of claim 5, further comprising a second spring return means for urging the unlatching member toward a rear rest position.

7. The device of claim 6, wherein the second spring return means includes at least one elastically deformable second return prong that is disposed axially between a radial front face of a rear section of the unlatching member and the rear face of the flange of the second connector.

8. The device of claim 7, where the first return prong and the second return prong are parts of a one-piece sheet metal multifunction spring bent and cut to shape.

9. The device of claim 8, wherein the multifunction spring is fixed to the male element.

10. The device of claim 9, wherein the multifunction spring includes at least one prong for attaching the male element to the associated second connector such that the assembly formed by the male element, the multifunction spring and the unlatching member is captive on the second connector.

11. The device of claim 3, wherein the radially projecting rear section of the unlatching member includes at least one portion projecting radially relative to a rear head of the male element such that the projecting portion of the radially projecting rear section constitutes a pusher member for driving the unlatching member toward a front unlatching position.

12. The device of claim 11, further comprising an actuation knurled wheel that is mounted to rotate freely on the rear head of the male element and includes a threaded portion adapted to cooperate with a complementary threaded portion of the unlatching member such that the unlatching member can be driven into a front unlatching position by rotating the knurled wheel.

13. The device of claim 12, wherein an assembly formed by the male element, the multifunction spring and the unlatching member has an axial plane of symmetry.

14. The device of claim 13, characterized in that the device includes an indicator device furnished with a visual indicator for indicating visually that the male element is occupying a front latching position in the female element.

15. The device of claim 14, wherein the indicator device comprises:

a pin that extends axially in the housing of the female element;

an axial open well that is delimited by the male element; and the visual indicator, which extends axially from the rear of the device toward the front of the device, in the well, from a visualization rear head to a drive front head, the indicator being mounted to slide axially in the well such that the indicator occupies a front position retracted or concealed in the well to which the indicator is returned elastically by return spring means when the male element occupies a rear rest position, and in that the indicator occupies a rear indicating position in which the front head of the indicator cooperates with the pin that opposes the spring return of the indicator when the male element occupies a front latching position in the female element such that the rear indicator head of the indicator can be seen by a user.

16. The device of claim 15, further comprising an additional male element that is fixed to an intermediate third connector that is disposed between the first connector and the second connector, the additional male element comprising:

an additional rear head delimiting an additional housing open axially rearward in which there is at least one additional retaining finger, and wherein the latching front section of the male element is adapted to be inserted axially in the direction from the rear of the device toward the front of the device, as far as a latching position in which the additional retaining finger is received in the retaining notch of the male element to immobilize the second connector axially on the intermediate third connector;

an additional latching front section that is furnished with an additional notch and is adapted to be inserted axially in the direction from the rear of the device toward the front of the device, into the housing of the female element as far as a latching position in which the retaining finger of the female element is received in the additional retaining notch to immobilize the intermediate third connector axially on the first connector; and an additional unlatching member that is carried by the additional male element and is adapted to slide axially in the direction from the rear of the device toward the front of the device, between the additional front latching section and the finger of the female element between a rear rest position and a front unlatching position in which the additional unlatching member retracts the retaining finger out of the additional notch.

17. The device of claim 16, further comprising a latching tool configures to drive the male element axially, wherein the latching tool includes:

a tubular portion that is adapted to be engaged axially around the head of the male element to center the head relative to the latching tool; and at least one axial arm a free end of which is adapted to bear axially on a radial rear branch of the first return lug cranked in a V-shape to drive the latching member into its front unlatching position.

18. The device of claim 17, further comprising an unlatching tool configured to cooperate with the unlatching member of the device, wherein a free end of the unlatching tool includes a radial edge adapted to cooperate by axial bearing engagement on the pusher member of the unlatching member in order to drive the unlatching member into an unlatching position before unlocking.

19. The device of claim 16, further comprising a multifunction tool, wherein the multifunction tool has the general shape of a rod, a first end of which includes a latching tool and an opposite second end of which includes an unlatching tool.

* * * * *